US011848182B2

(12) United States Patent
Oshikawa

(10) Patent No.: US 11,848,182 B2
(45) Date of Patent: Dec. 19, 2023

(54) METHOD AND DEVICE FOR PROCESSING IMAGING-ANALYSIS DATA

(71) Applicant: SHIMADZU CORPORATION, Kyoto (JP)

(72) Inventor: Tomonori Oshikawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 329 days.

(21) Appl. No.: 17/075,087

(22) Filed: Oct. 20, 2020

(65) Prior Publication Data

US 2021/0202223 A1 Jul. 1, 2021

(30) Foreign Application Priority Data

Dec. 26, 2019 (JP) ..... 2019-237277

(51) Int. Cl.
*H01J 49/00* (2006.01)

(52) U.S. Cl.
CPC ..... *H01J 49/0036* (2013.01); *H01J 49/0004* (2013.01)

(58) Field of Classification Search
CPC ... H01J 49/0036; H01J 49/0004; G01N 27/64
See application file for complete search history.

(56) References Cited

U.S. PATENT DOCUMENTS

2011/0150314 A1 6/2011 Bolea
2014/0316717 A1* 10/2014 Ikegami ..... H01J 49/0004 702/23
2016/0071711 A1 5/2016 Ikegami
2017/0352525 A1 12/2017 Ikegami et al.
2019/0369048 A1* 12/2019 Gentalen ..... G01N 30/6078

FOREIGN PATENT DOCUMENTS

JP 2011-515104 A 5/2011
WO 2014/175211 A1 10/2014
WO 2016/103312 A1 6/2016

OTHER PUBLICATIONS

Second Office Action dated Jul. 18, 2023 issued for the corresponding Japanese Patent Application No. 2019-237277.
Notification of Reasons for Refusal dated Feb. 7, 2023 from the Japanese Patent Office in application No. 2019-237277.

* cited by examiner

*Primary Examiner* — Walter L Lindsay, Jr.
*Assistant Examiner* — Geoffrey T Evans
(74) *Attorney, Agent, or Firm* — Sughrue Mion, PLLC

(57) ABSTRACT

In a device for processing imaging-analysis data, two kinds of imaging-analysis data are stored in a storage section 21: (a) first imaging-analysis data, in which measurement data of a target substance, acquired by performing a first predetermined analysis at each of a plurality of measurement points within an analysis target area of a sample S, is associated with spatial position information of the measurement point, and (b) second imaging-analysis data, in which measurement data of a reference substance, acquired by performing a second predetermined analysis at each of the measurement points, is associated with spatial position information of the measurement point. A normalization executer 28 normalizes the measurement data of the target substance at each measurement point, based on the measurement data of the reference substance acquired at the same measurement point.

7 Claims, 4 Drawing Sheets

METHOD AND DEVICE FOR PROCESSING IMAGING-ANALYSIS DATA

TECHNICAL FIELD

The present invention relates to a method and device for processing imaging-analysis data.

BACKGROUND ART

Imaging analysis is commonly performed to investigate the distribution of a target substance within an analysis target area of a biological sample (or other types of samples). One type of imaging analysis is imaging mass spectrometry. In the imaging mass spectrometry, mass spectrum data is acquired at each of a plurality of measurement points within an analysis target area. A measurement intensity value of an ion originating from a target substance is extracted from the mass spectrum data acquired at each measurement point, and an image in which intensity values are represented by the corresponding colors or grayscale values is created as an imaging-analysis result.

For the ionization of biological samples, matrix-assisted laser desorption/ionization (MALDI) has been widely used. A biological sample often has irregularities on its surface or non-uniformity in thickness. Ionizing such a sample by MALDI causes the ionization efficiency of the sample to vary depending on the measurement point. Therefore, an image created by extracting the measurement intensity value of an ion having a mass-to-charge ratio characteristic of a target substance from mass spectrum data acquired at each measurement point may not correctly reflect the distribution of the target substance.

Patent Literature 1 discloses the idea of using TIC normalization or XIC normalization to normalize mass spectrum data acquired at each measurement point. TIC is the abbreviation for the "total ion current" and means the total of the measurement intensity values of ions over the entire range of mass-to-charge ratios included in the mass spectrum data. A TIC of the mass spectrum data acquired at each measurement point is typically dominated by the measurement intensity values of the ions generated from a substance uniformly distributed over the analysis target area of the biological sample (e.g. a matrix substance or internal standard substance). Accordingly, in the TIC normalization, the mass spectrum data are normalized so that those data will have the same TIC value at all measurement points. On the other hand, XIC is the abbreviation for the "extract ion current" and means the measurement intensity value of an ion having a specific mass-to-charge ratio included in the mass spectrum data. In the XIC normalization, the mass-to-charge ratio of an ion generated from a substance uniformly distributed over the analysis target area of the biological sample (e.g. a matrix substance or internal standard substance) is selected as the specific mass-to-charge ratio mentioned earlier, and the mass spectrum data are normalized so that those data will have the same XIC value at all measurement points. An image created from the measurement intensity values of an ion having a mass-to-charge ratio characteristic of a target substance using mass spectrum data obtained through the TIC or XIC normalization can correctly reflect the distribution of the target substance.

CITATION LIST

Patent Literature

Patent Literature 1: WO 2016/103312 A

SUMMARY OF INVENTION

Technical Problem

Biological samples contain various foreign substances other than the target substance. Therefore, in a mass spectrometric analysis of a biological sample (or other types of samples), MS/MS analysis is often used to selectively perform a measurement for the target substance. In an MS/MS analysis, an ion having a specific mass-to-charge ratio is selected as a precursor ion from the ions generated from the sample. The precursor ion is subsequently dissociated into product ions, and the intensities of those ions are measured to obtain mass spectrum data (product-ion spectrum data). Even in the case where an ion generated from a foreign substance has the same mass-to-charge ratio as the precursor ion generated from the target substance, it is unlikely that the product ions produced from that ion are identical in mass-to-charge ratio (spectrum) to those produced from the precursor ion. Therefore, it is possible to selectively perform the measurement for an ion originating from the target substance by performing an MS/MS analysis.

As just described, in an MS/MS analysis, an ion having a specific mass-to-charge ratio is selected as the precursor ion. When the XIC normalization is performed on the product-ion spectrum data acquired through an MS/MS analysis of a target substance, an ion of a reference substance which will be the precursor ion needs to have the same mass-to-charge ratio as an ion of the target substance. Such a requirement is rarely satisfied, which means that the XIC normalization cannot always be performed. On the other hand, the TIC normalization, which is premised on that the measurement intensity value of an ion produced from a substance uniformly distributed over the analysis target area is dominant in the TIC of the mass spectrum data at each measurement point, cannot be performed if the ion having the specific mass-to-charge ratio is not abundantly produced from a substance uniformly distributed over the analysis target area of the biological sample.

Although the descriptions thus far have been concerned with the case of imaging mass spectrometry, similar problems can also occur in other types of imaging analyses which employ analysis methods other than mass spectrometry.

Thus, in the area of imaging analysis which use measurement data acquired at each of a plurality of measurement points within an analysis target area of a sample, the problem to be solved by the present invention is to provide a method and device for processing imaging-analysis data which can normalize measurement data of a target substance even in the case where the measurement data of the target substance and those of a reference substance cannot be obtained under one measurement condition.

Solution to Problem

The method for processing imaging-analysis data according to the present invention developed for solving the previously described problem includes the steps of:

- preparing first imaging-analysis data in which measurement data of a target substance contained in a sample, acquired by performing a first predetermined analysis at each of a plurality of measurement points within an analysis target area of the sample, is associated with spatial position information of the measurement point;
- preparing second imaging-analysis data in which measurement data of a reference substance contained in the sample, acquired by performing a second predetermined analysis at each of the plurality of measurement points, is associated with spatial position information of the measurement point, where the second predetermined analysis is different from the first predetermined analysis in terms of at least one of an analysis method and a measurement condition;

normalizing, for each of the plurality of measurement points, the measurement data of the target substance acquired at the measurement point, based on the measurement data of the reference substance acquired at the same measurement point.

The device for processing imaging-analysis data according to the present invention developed for solving the previously described problem includes:

a storage section configured to store (a) first imaging-analysis data in which measurement data of a target substance contained in a sample, acquired by performing a first predetermined analysis at each of a plurality of measurement points within an analysis target area of the sample, is associated with spatial position information of the measurement point, and (b) second imaging-analysis data in which measurement data of a reference substance contained in the sample, acquired by performing a second predetermined analysis at each of the plurality of measurement points, is associated with spatial position information of the measurement point, where the second predetermined analysis is different from the first predetermined analysis in terms of at least one of an analysis method and a measurement condition; and a normalization executer configured to normalize, for each of the plurality of measurement points, the measurement data of the target substance acquired at the measurement point, based on the measurement data of the reference substance acquired at the same measurement point.

Advantageous Effects of Invention

The preparation of the first and second imaging-analysis data can be done by actually performing the predetermined analyses or reading imaging-analysis data previously acquired and stored in a storage section or other locations.

In the method and device for processing imaging-analysis data according to the present invention, in addition to the first predetermined analysis performed at each of a plurality of measurement points to determine the distribution of a target substance, a second predetermined analysis which differs from the first predetermined analysis in terms of at least one of an analysis method and an analysis condition is performed to acquire measurement data of a reference substance at each of the plurality of measurement points. Then, the measurement data of the target substance is normalized based on the measurement data of the reference substance at each measurement point. By using the method and device for processing imaging-analysis data according to the present invention, the measurement data acquired at each measurement point can be normalized even when it is impossible to perform a measurement for both an ion of a target substance and an ion of a matrix substance or internal standard substance under one measurement condition.

DESCRIPTION OF EMBODIMENTS

One embodiment of the method and device for processing imaging-analysis data according to the present invention is hereinafter described with reference to the drawings. The method and device for an imaging analysis according to the present embodiment is an imaging mass spectrometry method and a mass spectrometer in which a mass spectrometric analysis is performed at each of a plurality of measurement points within an analysis target area of a sample.

Figure 1:
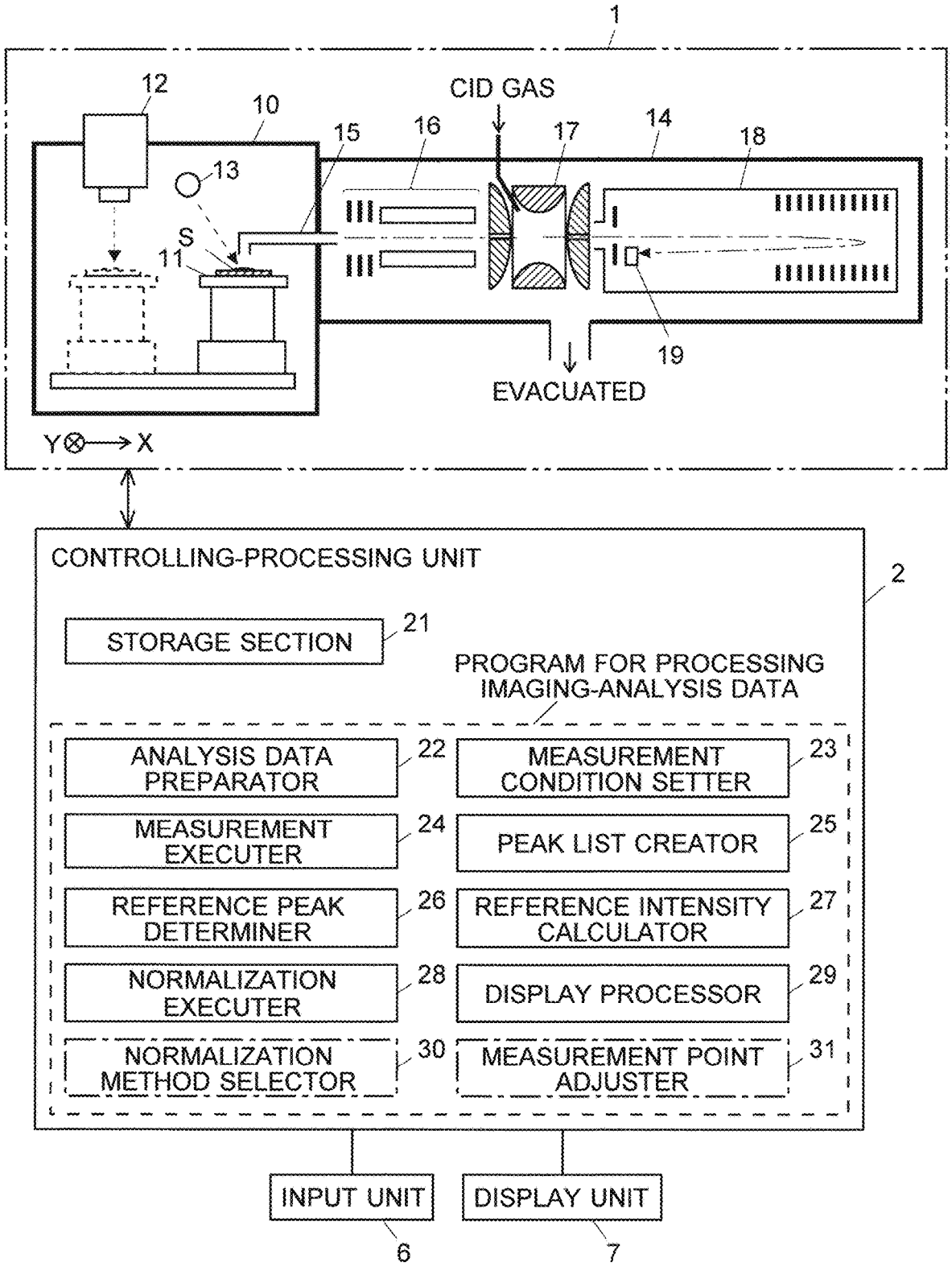
FIG. 1 is a configuration diagram showing the main components of an imaging mass spectrometry system including one embodiment of the device for processing imaging-analysis data according to the present invention.

FIG. 1 shows the configuration of the main components of an imaging mass spectrometry system including the device for processing imaging mass spectrometry data according to the present embodiment. The imaging mass spectrometer in the present embodiment includes a measurement unit 1 and a controlling-processing unit 2. The measurement unit 1 is configured to perform a mass spectrometric analysis for each of a large number of measurement points (micro areas) distributed in a lattice pattern within an analysis target area on a sample S, to acquire mass spectrum data for each measurement point. The controlling-processing unit 2 is configured to control the operation of the measurement unit 1 as well as store and process data acquired with the measurement unit 1.

The measurement unit 1 is a matrix assisted laser desorption/ionization ion trap time-of-flight mass spectrometer (MALDI-IT-TOFMS) capable of performing an MS' analysis. The measurement unit 1 includes an ionization chamber 10 maintained at substantially atmospheric pressure and a vacuum chamber 14 evacuated to a predetermined degree of vacuum by a vacuum pump (not shown).

The ionization chamber 10 contains a sample stage 11, imager 12, laser light irradiator 13, and ion-introducing unit 15. The sample stage 11 can be moved between an observing position indicated by the broken line in FIG. 1 and an analyzing position indicated by the solid line. The sample stage 11 is also configured so that the position of the sample S placed on the sample stage 11 can be changed in each of the two directions of X and Y axes which are orthogonal to each other in a horizontal plane. The imager 12 takes an optical image of the sample S on the sample stage 11 when this stage 11 is located at the observing position. The laser light irradiator 13 delivers an extremely thin beam of laser light onto the sample S when the sample stage 11 is located at the analyzing position.

The vacuum chamber 14 contains an ion guide 16, ion trap 17, flight tube 18, and ion detector 19. The ion guide 16 receives ions generated from the sample S within the ionization chamber 10 and introduced into the vacuum chamber 14 through the ion introducing unit 15, as well as transports those ions to the subsequent stage while converging them. The ion trap 17 temporarily captures ions by a radio-frequency electric field, as well as selects a precursor ion according to the type of mass spectrometric analysis and fragments the precursor ion by collision-induced dissociation (CID). The flight tube 18 receives ions ejected from the ion trap 17 and separates them according to their mass-to-charge ratios. The ion detector 19 detects the ions separated from each other according to their mass-to-charge ratios by the flight tube 18.

The controlling-processing unit 2 includes a storage section 21 as well as an analysis data preparator 22, measurement condition setter 23, measurement executer 24, peak list creator 25, reference peak determiner 26, reference intensity calculator 27, normalization executer 28, and display processor 29 as its functional blocks. The controlling-processing unit 2 is actually a personal computer, with those functional blocks embodied by executing, on a processor, a program for processing imaging-analysis data previously installed on the same computer. An input unit 6 including a keyboard and a pointing device (e.g. mouse) as well as a display unit 7, such as a liquid crystal display, are connected to the controlling-processing unit 2. The normalization method selector 30 and measurement point adjuster 31 indicated by the alternate long and short dash lines in FIG. 1 are intended for use in one preferable variation of the present embodiment.

Figure 2:
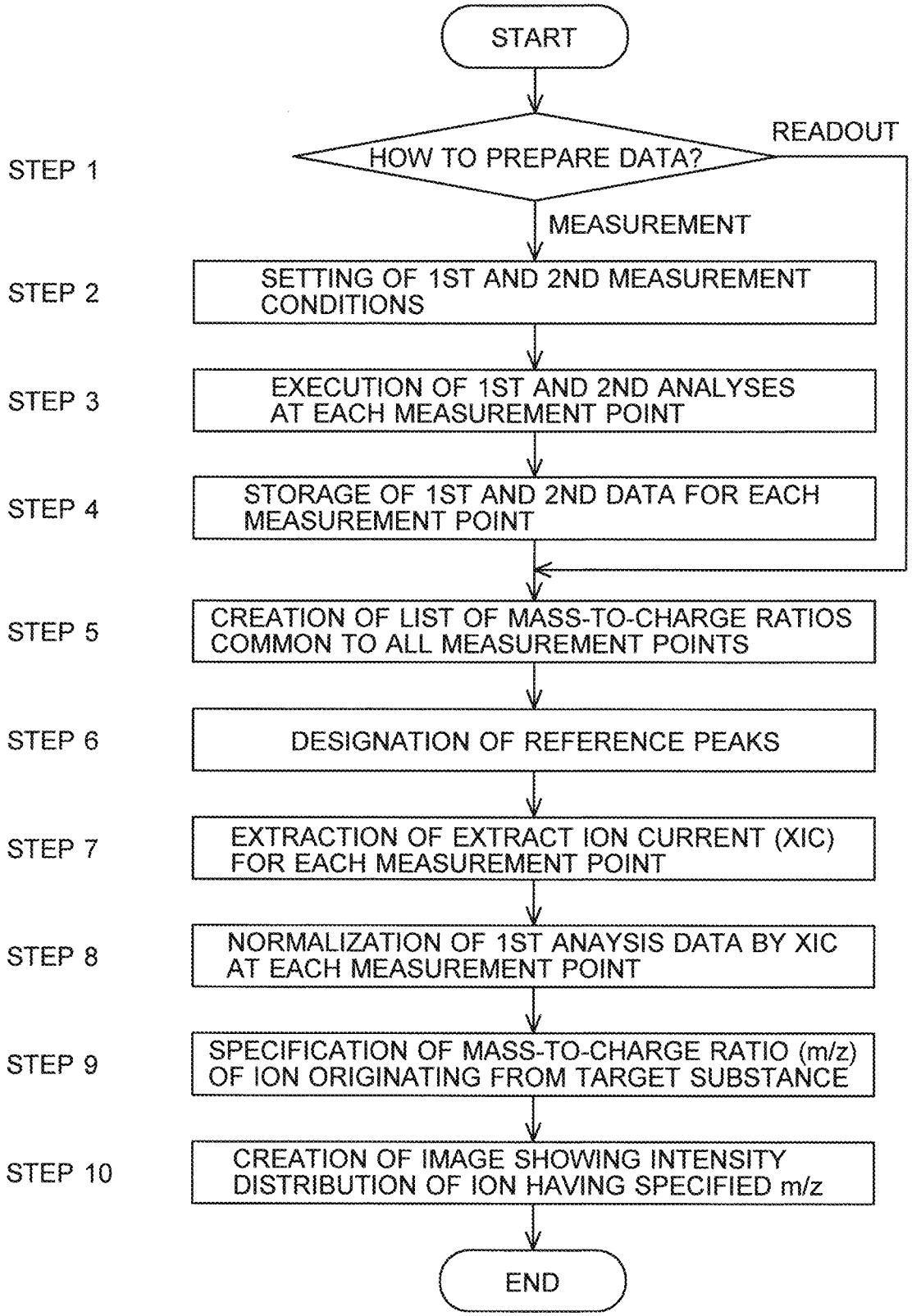
FIG. 2 is a flowchart concerning one embodiment of the method for processing imaging-analysis data according to the present invention.

Next, the procedure for executing the imaging mass spectrometry method according to the present embodiment is described with reference to the flowchart shown in FIG. 2. Initially, the first and second imaging-analysis data are prepared. The first imaging-analysis data is a set of data in which measurement data of a target substance contained in the sample S, acquired by performing a first mass spectrometric analysis at each of a plurality of measurement points within an analysis target area of the sample S, is associated with spatial position information of the measurement point. The second imaging-analysis data is a set of data in which measurement data of a reference substance contained in the sample S, acquired by performing a second mass spectrometric analysis at each of the plurality of measurement points, is associated with spatial position information of the measurement point, where the second mass spectrometric analysis is different from the first mass spectrometric analysis in terms of the measurement condition.

The preparation of the first and second imaging-analysis data can be done by actually performing the measurement on the sample S or reading data acquired by previous measurements. Accordingly, the analysis data preparator 22 displays, on the display unit 7, a screen for asking a user to specify how to prepare the first and second imaging-analysis data ("Measurement" or "Readout").

If the user has selected "Readout" (i.e. if "Readout" is selected in Step 1), the analysis data preparator 22 displays, on the screen of the display unit 7, a list of a predetermined type of data files stored in the storage section 21 (i.e. a list of files having a predetermined extension associated with the imaging-analysis data), and allows the user to specify a first imaging-analysis data file and a second imaging-analysis data file. When the two files have been specified by the user, the analysis data preparator 22 reads the specified files and prepares those files as the first and second imaging-analysis data files, respectively. In the case where the imaging-analysis data have been prepared through the selection of "Readout", the operation proceeds to Step 5.

If the user has selected "Measurement" (i.e. if "Measurement" is selected in Step 1), the measurement condition setter 23 displays a measurement condition setting screen on the display unit 7 and allows the user to set the first and second measurement conditions (Step 2). The first measurement condition is the condition of a mass spectrometric analysis to be performed for the measurement of the target substance contained in the sample S. The second measurement condition is the condition of a mass spectrometric analysis to be performed for the measurement of the reference substance which serves as the reference for the normalization of the mass spectrum data acquired through the mass spectrometric analysis under the first measurement condition. For example, the reference substance may be an internal standard substance or matrix substance mixed in or with the sample S.

The measurement condition includes the selection of the type of mass spectrometry (e.g. MS scan, SIM, MS/MS, MRM or other types of measurements) and the mass-to-charge ratio of an ion (or mass-to-charge-ratio range of ions) to be selected and detected in the selected type of mass spectrometry. After the user has determined the first and second measurement conditions, the measurement condition setter 23 creates a method file describing those measurement conditions and stores the file in the storage section 21. The following descriptions deal with the example in which a product ion scan measurement (MS/MS analysis) with an ion having a mass-to-charge ratio (m/z) of A selected as the precursor ion is performed in the first measurement, while a product ion scan measurement (MS/MS analysis) with an ion having a mass-to-charge ratio (m/z) of B selected as the precursor ion is performed in the second measurement. The task of determining the measurement conditions may alternatively be performed by reading a previously created method file or selecting a target compound and standard substance from a compound database prepared beforehand on the storage section 21.

After the measurement conditions have been set, the user sets, on the sample stage 11, a sample S prepared, for example, by applying an appropriate matrix to an analyte, such as a biological tissue section, and performs a predetermined input operation to instruct the initiation of the measurement. Then, the measurement executer 24 transfers the sample stage 11 to the observing position (indicated by the broken line in FIG. 1) and operates the imager 12 to take an optical image of the surface of the sample S. The data of the taken optical image is stored in the storage section 21. Additionally, the optical image is displayed on the screen of the display unit 7. The user, referring to the optical image displayed on the screen of the display unit 7, subsequently selects an area on the sample S. The measurement executer 24 designates the selected area as the analysis target area and sets a plurality of measurement points within this area.

With the analysis target area thus set, the measurement executer 24 performs the first and second analyses at each measurement point as follows (Step 3): Initially, the sample stage 11 is transferred to the analyzing position (indicated by the solid line in FIG. 1). A pulsed laser beam is delivered from the laser light irradiator 13 onto a predetermined position (measurement-beginning point) on the sample S placed on the sample stage 11. The pulsed laser beam delivered from the laser light irradiator 13 onto the measurement point on the sample S causes ionization of the components of the sample S present at the measurement point. The generated ions are introduced through the ion-introducing unit 15 into the vacuum chamber 14, where the ions are converged by the ion guide 16, to be introduced into and retained within the ion trap 17.

Within the ion trap 17, a predetermined radio-frequency voltage (or a radio-frequency voltage with a direct-current voltage superposed) is applied to the ring electrode to select an ion having a mass-to-charge ratio of A as the precursor ion. Subsequently, inert gas (e.g. nitrogen gas) is introduced from a gas-introducing unit (not shown) into the ion trap 17, and the precursor ion is excited within the ion trap 17 to fragment the ion into product ions by collision-induced dissociation.

The product ions produced within the ion trap 17 are simultaneously ejected into the flight space within the flight tube 18 at a predetermined timing. The ions fly in the flight space and ultimately reach the ion detector 19. While flying in the flight space, the various kinds of ions are separated from each other according to their mass-to-charge ratios and sequentially reach the ion detector 19 in ascending order of mass-to-charge ratio. The ion detector 19 produces analogue detection signals, which are converted into digital data by an analogue-to-digital converter (not shown). Those data are stored in the storage section 21.

After the measurement data at one measurement point (measurement-beginning point) within the analysis target area of the sample S has been stored in this manner, the sample stage 11 is transferred to so that the next measurement point on the sample S comes to the laser irradiation position. The operations described thus far are repeated to collect mass spectrum data for all measurement points within the analysis target area of the sample S. The mass spectrum data (product-ion spectrum data) respectively acquired at all measurement points are stored in the storage section 21 as the first imaging-analysis data.

After the first imaging-analysis data have been acquired, mass spectrum data (product-ion spectrum data) for all measurement points are once more acquired by the same procedure as described thus far (except for the mass-to-charge ratio of the precursor ion to be selected in the ion trap, which is now changed to B), and the acquired data are stored in the storage section 21 as the second imaging-analysis data (Step 4).

With the first and second imaging-analysis data thus prepared, the peak list creator 25 reads the second imaging-analysis data and extracts peaks from the product-ion spectrum data acquired at each measurement point. Subsequently, the peak list creator 25 creates a list of mass-to-charge ratios common to the peaks extracted at all measurement points (Step 5).

Figure 3:
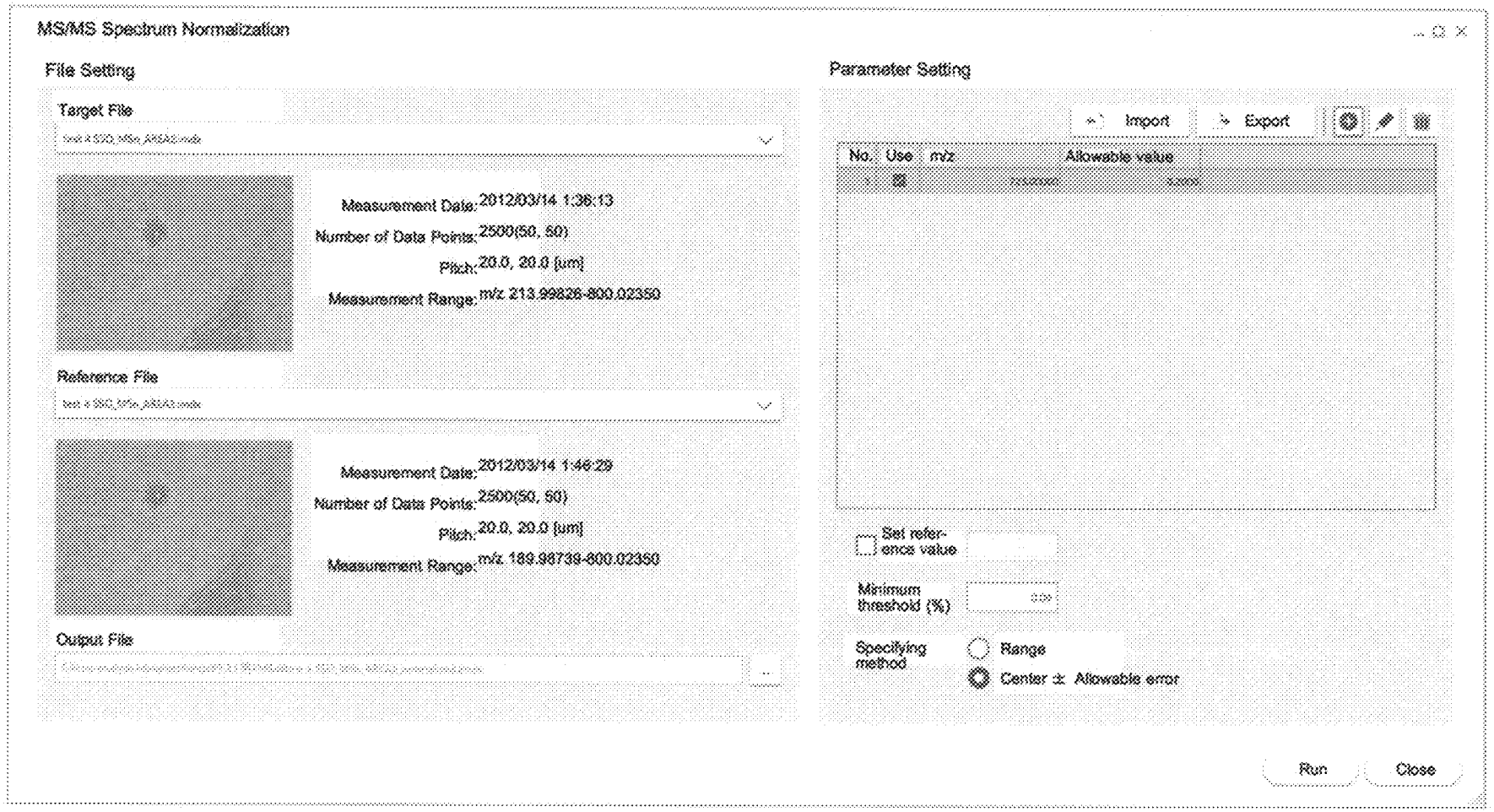
FIG. 3 is one example of a display screen in the device and method for processing imaging-analysis data according to the present embodiment.

FIG. 3 shows one example of the screen display. The "Target File" shown in FIG. 3 corresponds to the first imaging-analysis data, while the "Reference File" corresponds to the second imaging-analysis data. The threshold shown in the lower right section of FIG. 3 is set in order to prevent the first imaging-analysis data from being extremely large as a result of the normalization at a measurement point at which the intensity of the reference peak in the second imaging-analysis data is extremely low, though not zero. If the intensity in the second imaging-analysis data is not higher than this threshold, the normalization at the measurement point concerned is omitted. The setting and use of this threshold are optional for the present invention. It is unnecessary to set the threshold if the reference peak at any measurement point in the second imaging-analysis data is sufficiently high.

Subsequently, the reference peak determiner 26 displays, on the screen of the display unit 7, the list created by the peak list creator 25, and allows the user to specify one of the listed mass-to-charge ratios. The user specifies one or more of the mass-to-charge ratios. Then, the reference peak determiner 26 designates the peaks of the ions having those mass-to-charge ratios as the reference peaks (Step 6). For example, in the case where MALDI is used for the ionization as in the present embodiment, the user specifies the mass-to-charge ratio of the peak corresponding to an ion originating from the matrix substance. If an internal standard substance is uniformly mixed in the sample S, the user may specify the mass-to-charge ratio of the peak corresponding to an ion originating from the internal standard substance.

Subsequently, the reference intensity calculator 27 extracts the intensity of each reference peak (the intensity of the peak at each mass-to-charge ratio specified by the user: XIC) from the product-ion spectrum data acquired at each measurement point in the second imaging-analysis data (Step 7).

Since each of the mass-to-charge ratios specified by the user is the mass-to-charge ratio of an ion originating from a substance uniformly distributed within the analysis target area of the sample, such as the matrix substance or standard substance, the XIC should have the same value at all measurement points if the ionization efficiency is uniform at all measurement points.

However, in actual measurements, it is often the case that the ionization efficiency becomes non-uniform due to the presence of irregularities on the surface of the sample S or the variation in the thickness of the sample S depending on the measurement point. The XIC extracted in the previously described manner can be considered to be a value that reflects the ionization strength at each measurement point.

After the XIC values at all measurement points have been extracted, the normalization executer 28 reads product-ion spectrum data of each measurement point from the first imaging-analysis data and divides each intensity value in the spectrum data of each measurement point by the XIC intensity at the corresponding measurement point. If a plurality of mass-to-charge ratios have been specified in Step 6 and there are multiple reference peaks, the intensity should be divided by the sum of the XIC intensities of those reference peaks. Thus, the product-ion spectrum data of each measurement point included in the first imaging-analysis data are normalized (Step 8).

Figure 4:
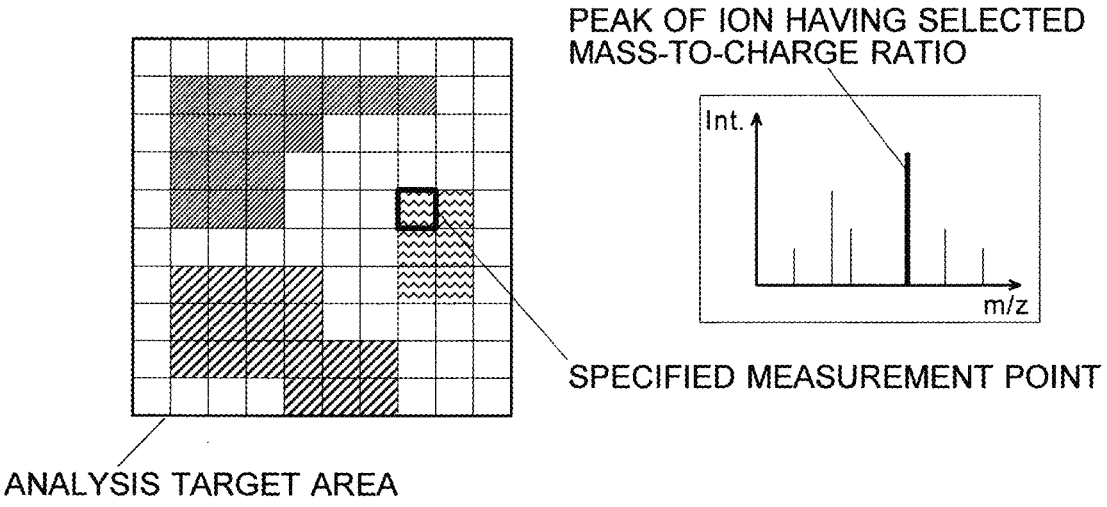
FIG. 4 is a display example of the result of an imaging analysis in the device and method for processing imaging-analysis data according to the present embodiment.

After the product-ion spectrum data of all measurement points included in the first imaging-analysis data have been normalized, the display processor 29 allows the user to indicate the mass-to-charge ratio of an ion originating from the target substance (Step 9). After the mass-to-charge ratio has been specified by the user, the display processor 29 reads the intensity of the peak of the ion having the specified mass-to-charge ratio (XIC) from the product-ion spectrum data at each measurement point in the first imaging-analysis data, creates image data in a form that allows visual recognition of the intensity of each peak (imaging data), and displays, on the screen of the display unit 7, an image showing the intensity distribution of the ion having the specified mass-to-charge ratio (Step 10). As for the form that allows visual recognition of the intensity of each peak, different color or grayscale values may be given depending on the intensity, for example. FIG. 4 is a model diagram showing a display example. In this figure, for convenience of patent application drawings, different hatching patterns are given depending on the intensity. When the user changes the value of the mass-to-charge ratio, the display processor 29 reads the intensity of the peak of the ion having the new mass-to-charge ratio and displays, on the screen of the display unit 7, image data in which different colors or grayscale values are given depending on the intensity (imaging data). Furthermore, when the user selects one measurement point on the screen of the display unit 7 by the clicking operation (or other appropriate operations), the display processor 29 displays a product ion spectrum based on the product-ion spectrum data acquired at the measurement point concerned. In the example shown in FIG. 4, the measurement point surrounded by the thick frame is selected, and the corresponding mass spectrum is displayed on the right side of the image data. Among the peaks on the mass spectrum, the peak corresponding to the mass-to-charge ratio specified by the user is highlighted.

The previous embodiment is a mere example and can be appropriately changed or modified within the spirit of the present invention.

The controlling-processing unit 2 in the previous embodiment may additionally include a normalization method selector 30 as its functional block so that either XIC normalization or TIC normalization can be selected as the normalization method, rather than performing only the XIC normalization as in the previous embodiment. For example, an MS/MS measurement using an ion characteristic of the reference substance (matrix substance or internal standard substance) as the precursor ion may be performed in the second analysis to acquire product-ion spectrum data at each measurement point, in which case the first imaging-analysis data can be normalized using the TIC intensity of the product-ion spectrum data as the reference intensity. As another example, an MS analysis may be performed as the second analysis to acquire mass spectrum data, in which case the TIC normalization can be performed using the total of the peak intensities (TIC) of the mass spectrum at each measurement point. A multiple reaction monitoring (MRM) analysis may also be performed in the second analysis to measure the intensity of a product ion having a specific mass-to-charge ratio at each measurement point, in which case the measured intensity can be used as the reference intensity to normalize the first imaging-analysis data. For the MRM analysis, for example, the ion trap 17 of the measurement unit 1 in the previous embodiment can be operated so that a precursor ion is selected and dissociated into product ions, from which a product ion having a specific mass-to-charge ratio is selected.

In the previous embodiment, a MALDI-IT-TOFMS is used as the measurement unit 1. A mass spectrometer having a different configuration may also be used. For example, a probe electrospray ionization (PESI) source or laser ablation inductively coupled plasma (LA-ICP) ionization source, both of which collect and ionize the sample S at each measurement point, may be used for the ionization. A mass separator other than the IT-TOF may also be used (e.g. a triple quadrupole type of mass filter). It is not always necessary to include the measurement unit 1. For example, if the device for processing imaging-analysis data should be configured to process only imaging-analysis data already stored in the storage section 21, the device can be constructed from only the required functional blocks included in the controlling-processing unit 2.

Any of the previously described examples are concerned with the case of acquiring imaging-analysis data by mass spectrometry. A technique different from mass spectrometry may also be used for acquiring the first and/or second imaging-analysis data. For example, the first and/or second imaging-analysis data may be acquired at each measurement point of the sample S by energy dispersive X-ray spectroscopy (EDX), or an analysis using an electron probe micro analyzer (EPMA) or a scanning electron microscope equipped with an energy dispersive X-ray spectroscope (SEM-EDS). In the case of analyzing an organic substance, the first and/or second imaging-analysis data may be acquired by an analysis using a Fourier transform infrared spectrophotometer (FTIR) or Raman spectrometer. In any of these cases, as in the previous embodiment, a set of data concerning a predetermined physical quantity related to the target substance is acquired at each measurement point as the first imaging-analysis data, while a set of data concerning the predetermined physical quantity related to the standard substance uniformly distributed within the analysis target area of the sample S is acquired at each measurement point as the second imaging-analysis data. A reference intensity at each measurement point can be determined from the second imaging-analysis data, and the first imaging-analysis data can be normalized by dividing the predetermined physical quantity related to the target substance at each measurement point in the first imaging-analysis data by the reference intensity at the corresponding measurement point.

If the first and second analyses employ different techniques, a discrepancy may occur between the position of the plurality of measurement points in the first imaging-analysis data and that of the plurality of measurement points in the second imaging-analysis data. In such a case, the controlling-processing unit 2 in the previous embodiment may additionally include a measurement point adjuster 31 as its functional block, which defines the measurement points in one of the first and second imaging-analysis data as the reference points and combines each reference point with analysis data acquired at a plurality of measurement points in the other imaging-analysis data (e.g. by integrating analysis data acquired at a plurality of measurement points surrounding the reference point, with each piece of data appropriately weighted) to establish correspondence in the position of the measurement points between the two sets of imaging-analysis data. After this processing, the normalization can be performed in a similar manner to the previous embodiment.

MODES OF INVENTION

A person skilled in the art can understand that the previously described illustrative embodiments are specific examples of the following modes of the present invention.

(Clause 1)

A method for processing imaging-analysis data according to one mode of the present invention includes the steps of:

preparing first imaging-analysis data in which measurement data of a target substance contained in a sample, acquired by performing a first predetermined analysis at each of a plurality of measurement points within an analysis target area of the sample, is associated with spatial position information of the measurement point;

preparing second imaging-analysis data in which measurement data of a reference substance contained in the sample, acquired by performing a second predetermined analysis at each of the plurality of measurement points, is associated with spatial position information of the measurement point, where the second predetermined analysis is different from the first predetermined analysis in terms of at least one of an analysis method and a measurement condition;

normalizing, for each of the plurality of measurement points, the measurement data of the target substance acquired at the measurement point, based on the measurement data of the reference substance acquired at the same measurement point.

(Clause 2)

A device for processing imaging-analysis data according to another mode of the present invention includes:

a storage section configured to store (a) first imaging-analysis data in which measurement data of a target substance contained in a sample, acquired by performing a first predetermined analysis at each of a plurality of measurement points within an analysis target area of the sample, is associated with spatial position information of the measurement point, and (b) second imaging-analysis data in which measurement data of a reference substance contained in the sample, acquired by performing a second predetermined analysis at each of the plurality of measurement points, is associated with spatial position information of the measurement point, where the second predetermined analysis is different from the first predetermined analysis in terms of at least one of an analysis method and a measurement condition; and a normalization executer configured to normalize, for each of the plurality of measurement points, the measurement data of the target substance acquired at the measurement point, based on the measurement data of the reference substance acquired at the same measurement point.

In the method for processing imaging-analysis data described in Clause 1, and the device for processing imaging-analysis data described in Clause 2, in addition to the first predetermined analysis performed at each of a plurality of measurement points to determine the distribution of a target substance, a second predetermined analysis which differs from the first predetermined analysis in terms of at least one of an analysis method and an analysis condition is performed to acquire measurement data of a reference substance at each of the plurality of measurement points. Then, the measurement data of the target substance is normalized based on the measurement data of the reference substance at each measurement point. By using the method and device for processing imaging-analysis data according to the present invention, the measurement data acquired at each measurement point can be normalized even when it is impossible to perform a measurement for both an ion of a target substance and an ion of a matrix substance or internal standard substance under one measurement condition.

(Clause 3)

In the device for processing imaging-analysis data described in Clause 2, the first imaging-analysis data may be spectrum data acquired at each of the plurality of measurement points.

(Clause 4)

In the device for processing imaging-analysis data described in Clause 3, the spectrum data may be mass spectrum data.

In the device for processing imaging-analysis data described in Clause 3, the analysis accuracy can be improved by appropriately selecting a suitable intensity value for the analysis of the target substance from a plurality of intensity values included in the spectrum data. For example, in the device for processing imaging-analysis data described in Clause 4, the influence of foreign substances which coexist in the sample can be eliminated from a quantitative analysis of the distribution of the target substance by selecting the mass-to-charge ratio of the most characteristic ion for the target substance. Additionally, the image for checking the result of the imaging analysis on the analysis target area image can be switched among a plurality of mass-to-charge ratios. This allows the viewer to confirm that the image correctly represents the distribution of the target substance.

(Clause 5)

In the device for processing imaging-analysis data described in one of Clauses 2-4, the second imaging-analysis data may be spectrum data acquired at each of the plurality of measurement points.

(Clause 6)

In the device for processing imaging-analysis data described in Clause 5, the normalization executer may be configured to normalize the measurement data of the target substance using the intensity of one of the peaks included in the spectrum data.

In the device for processing imaging-analysis data described in Clause 5, the accuracy of the intensity value to be used as the reference for the normalization can be improved by appropriately selecting an intensity value uniformly distributed within the analysis target area of the sample from a plurality of intensity values included in the spectrum data. For example, in the device for processing imaging-analysis data described in Clause 6, the accuracy of the intensity value to be used as the reference for the normalization can be improved by selecting the mass-to-charge ratio of the most characteristic ion among the ions originating from a matrix substance, internal standard substance or similar type of substance.

(Clause 7)

The device for processing imaging-analysis data described in Clause 4 may further include a normalization method selector configured to allow a user to select either XIC normalization or TIC normalization as a normalization method, and the normalization executer may be configured to normalize the measurement data of the target substance by the selected method.

In the device for processing imaging-analysis data described in Clause 7, the XIC normalization or TIC normalization can be selected according to the characteristics of the mass spectrum data at each measurement point included in the second imaging-analysis data. For example, selecting the XIC normalization allows for a more accurate determination of the reference intensity at each measurement point, whereas selecting the TIC normalization allows for an easier calculation of the reference intensity.

REFERENCE SIGNS LIST

1 . . . Measurement Unit
10 . . . Ionization Chamber
11 . . . Sample Stage
12 . . . Imager
13 . . . Laser Light Irradiator
14 . . . Vacuum Chamber
15 . . . Ion-Introducing Unit
16 . . . Ion Guide
17 . . . Ion Trap
18 . . . Flight Tube
19 . . . Ion Detector
2 . . . Controlling-Processing Unit
21 . . . Storage Section
22 . . . Analysis Data Preparator
23 . . . Measurement Condition Setter
24 . . . Measurement Executer
25 . . . Peak List Creator
26 . . . Reference Peak Determiner
27 . . . Reference Intensity Calculator
28 . . . Normalization Executer
29 . . . Display Processor
30 . . . Normalization Method Selector
31 . . . Measurement Point Adjuster
6 . . . Input Unit
7 . . . Display Unit
S . . . Sample

The invention claimed is:

1. A method for processing imaging-analysis data, comprising steps of:

preparing first imaging-analysis data in which measurement data of a target substance contained in a sample, acquired by performing a first predetermined analysis at each of a plurality of measurement points within an analysis target area of the sample, is associated with spatial position information of the measurement point;

preparing second imaging-analysis data in which measurement data of a reference substance contained in the sample, acquired by performing a second predetermined analysis at each of the plurality of measurement points, is associated with spatial position information of the measurement point, where the second predetermined analysis is different from the first predetermined analysis in terms of at least one of an analysis method and a measurement condition;

normalizing, for each of the plurality of measurement points, the measurement data of the target substance acquired at the measurement point, based on the measurement data of the reference substance acquired at the same measurement point.

2. A device for processing imaging-analysis data, comprising:

a storage section configured to store (a) first imaging-analysis data in which measurement data of a target substance contained in a sample, acquired by performing a first predetermined analysis at each of a plurality of measurement points within an analysis target area of the sample, is associated with spatial position information of the measurement point, and (b) second imaging-analysis data in which measurement data of a reference substance contained in the sample, acquired by performing a second predetermined analysis at each of the plurality of measurement points, is associated with spatial position information of the measurement point, where the second predetermined analysis is different from the first predetermined analysis in terms of at least one of an analysis method and a measurement condition; and a normalization executer configured to normalize, for each of the plurality of measurement points, the measurement data of the target substance acquired at the measurement point, based on the measurement data of the reference substance acquired at the same measurement point.

3. The device for processing imaging-analysis data according to claim 2, wherein the first imaging-analysis data is spectrum data acquired at each of the plurality of measurement points.

4. The device for processing imaging-analysis data according to claim 3, wherein the spectrum data is mass spectrum data.

5. The device for processing imaging-analysis data according to claim 4, further comprising a normalization method selector configured to allow a user to select either XIC normalization or TIC normalization as a normalization method, wherein the normalization executer is configured to normalize the measurement data of the target substance by the selected method.

6. The device for processing imaging-analysis data according to claim 2, wherein the second imaging-analysis data is spectrum data acquired at each of the plurality of measurement points.

7. The device for processing imaging-analysis data according to claim 5, wherein the normalization executer is configured to normalize the measurement data of the target substance using an intensity of one of peaks included in the spectrum data.

* * * * *